US006591878B2

(12) United States Patent
Hinchliff

(10) Patent No.: US 6,591,878 B2
(45) Date of Patent: Jul. 15, 2003

(54) METHOD AND APPARATUS FOR CLAMPING A KNIFE

(75) Inventor: Thomas Charles Hinchliff, Lake Oswego, OR (US)

(73) Assignee: Key Knife, Inc., Tualatin, OR (US)

( * ) Notice: Subject to any disclaimer, the term of this patent is extended or adjusted under 35 U.S.C. 154(b) by 0 days.

(21) Appl. No.: 09/908,918

(22) Filed: Jul. 18, 2001

(65) Prior Publication Data

US 2003/0015254 A1 Jan. 23, 2003

(51) Int. Cl.[7] ..... B27C 5/00; B27C 1/00

(52) U.S. Cl. ..... 144/241; 144/162.1; 144/218; 144/230; 241/92; 241/298; 407/41; 407/48; 407/113

(58) Field of Search ..... 144/162.1, 176, 144/218, 230, 231, 241; 407/41, 49, 102, 31, 32, 113; 241/92, 278.1, 296, 298

(56) References Cited

U.S. PATENT DOCUMENTS 3,981,337 A 9/1976 Sundstrum
4,047,670 A 9/1977 Svensson
4,271,882 A 6/1981 Valo
4,850,408 A 7/1989 Carpenter et al. ..... 144/241
4,997,018 A 3/1991 Carpenter et al.
5,271,440 A 12/1993 Bradstreet, Jr. et al.
5,819,826 A 10/1998 Schmatjen
5,979,522 A 11/1999 Swartwood et al. ..... 144/176

*Primary Examiner*—W. Donald Bray
(74) *Attorney, Agent, or Firm*—Birdwell, Janke & Durando, PLC

(57) ABSTRACT

A method and apparatus for clamping a knife. A front side of the knife includes a recess and the knife is clamped between an outer clamping member adapted to receive the back side of the knife, and a inner clamping member adapted to receive the front side of the knife, the inner clamping member making contact with the front side of the knife at two spaced locations thereon, wherein at least one of the locations is outside the recess and the other is inside the recess, wherein the width of the recess normalized by the overall width of the knife yields a result that is preferably no more than about 0.22.

20 Claims, 4 Drawing Sheets

Fig. 7
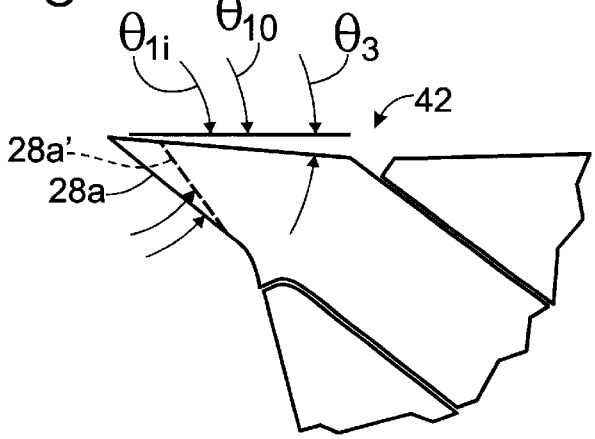
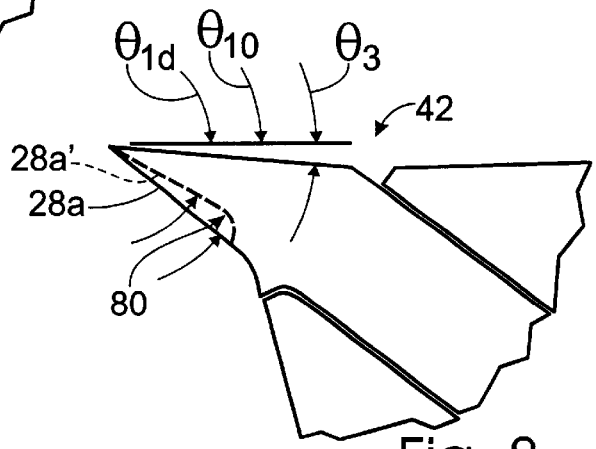
Fig. 8
Fig. 9
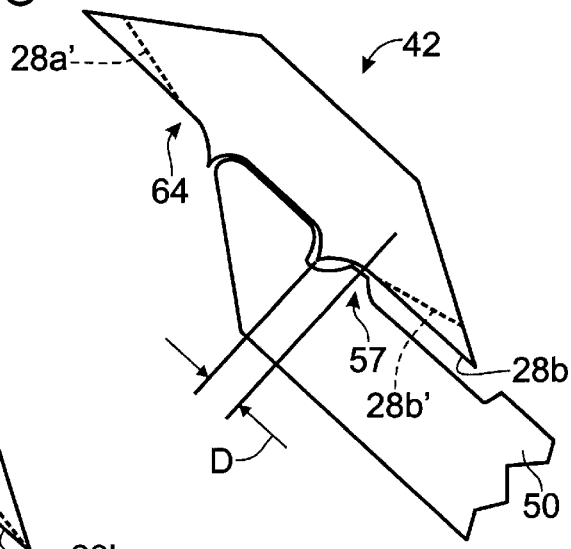
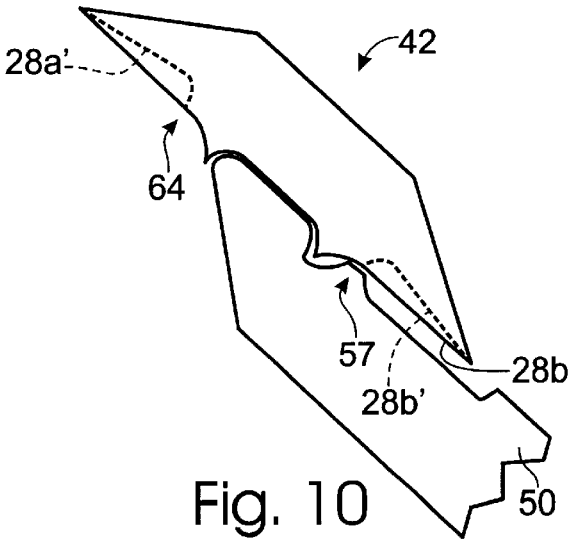
Fig. 10

METHOD AND APPARATUS FOR CLAMPING A KNIFE

The subject matter of the present application is related to that of the assignee's companion application entitled KNIFE AND APPARATUS FOR CLAMPING A KNIFE, of Loren R. Schuh and Tobias L. Simonsen, incorporated by reference herein in its entirety.

BACKGROUND OF THE INVENTION

The present invention relates to a method and apparatus for clamping a knife in a wood chipper, such as a disc, drum or conical head chipper, for use in the commercial processing of logs.

In wood chipping apparatus used in the forest products industry, a rotating member is provided for receiving replaceable knives for cutting chips from the log. Each knife is typically clamped to the rotating member between an outer clamping member and an inner clamping member or counterknife, wherein the knife and counterknife together form a surface against which the log is forced to remove chips from the log. The chips themselves have commercial value, and their removal shapes the log into lumber and finishes its surface.

A preferred knife for use in such apparatus is manufactured by Key Knife, Inc., of Tualatin, Oreg. ("Key Knife"), and described in Schmatjen, U.S. Pat. No. 5,819,826, herein incorporated by reference in its entirety. For convenience when referring to the '826 patent, terminology employed therein will be used herein as well to describe selected features of the preferred knife.

The knife is elongate and symmetrical about a plane that includes the elongate axis, to provide two cutting edges of the knife. Therefore, either of the cutting edges may be selected for cutting by appropriate installation of the knife. Particularly, when one of the cutting edges is dulled, the knife may be removed from the apparatus, turned end-to-end, and placed back into the apparatus to obtain a fresh cutting edge, providing an outstanding advantage over knives having a single cutting edge.

The knife includes a front side which, when the knife is installed in the apparatus, confronts the counterknife, and a back side which confronts the outer clamping member. Each cutting edge of the knife defines a line terminating two plane surfaces that form an angle with respect to one another, known in the art as the knife angle. The front side of the knife contains one each of the aforementioned plane surfaces (termed "lower knife-edge-joining portions") and the back side of the knife contains one each of the other of the plane surfaces (termed "upper knife-edge-joining portions").

The front side of the knife further includes a pair of symmetrically disposed deflector ridges projecting therefrom, and extending in the direction of the elongate axis. The deflector ridges are spaced from the respective cutting edges and terminate the respective lower knife-edge-joining portions.

The front side of the knife still further includes a pressure-applying surface portion between the deflector ridges. The pressure-applying surface portion makes contact with a corresponding feature of the counterknife when clamping the knife in the apparatus. Typically, the lower knife-edge-joining portions and the pressure-applying surface portion all lie in a single plane.

Grinding machines are employed to form the aforementioned surfaces. The time required for the grinding operation depends on the number of knives that can be ground by the machine at one time, and this number depends on the size of the knives. The present inventor has recognized that it would be desirable to reduce the width of a knife to reduce the size of the knife and, therefore, manufacturing time and cost.

However, the distance from the cutting edge of the knife to the respective deflector ridges is determined by the requirements of the chipping apparatus and may not be reduced without impacting the performance of the apparatus. On the other hand, reducing the width of the pressure-applying area destabilizes the contact between the knife and the counterknife.

A prior art counterknife manufactured and marketed by Key Knife, Inc. provides a contact point between the knife and counterknife that is outside of the space between the deflector ridges, more particularly 0.583" from the closest one of the deflector ridges. This counterknife permits the use of a knife having a narrower pressure-applying area, providing for decreased manufacturing costs, while maintaining stable contact with the knife.

In what has heretofore been an unrelated consideration, chipper knives are angled with respect to the wood being cut, wherein the angle is known to be important to chip quality. As mentioned, the angle between the upper and lower knife-edge-joining portions defines the knife angle. The knife when clamped in the apparatus also defines an angle known in the art as the "attack angle," and a "relief angle" that is the difference between the attack angle and the knife angle. Adjustment of one or more of these angles is desirable to account for changed conditions, such as changes in the wood or changes in environmental factors such as temperature and humidity.

The typical prior art method for effecting such adjustments is grinding the upper knife-edge-joining portion, which alters the knife angle and relief angle. The attack angle is not altered by this grinding.

Prior art knives provided by Key Knife, Inc. are distinguished from other prior art knives in having the pressure-applying area for contacting the counterknife effectively recessed into the knife. For example, in knives with deflector ridges the pressure-applying area is recessed with respect to the deflector ridges, and in an earlier form of the knife a recessed keyway was provided for the pressure-applying area. Accordingly, the counterknife contacts the pressure-applying area in a region that is outside of the path of the moving chips so that packing cannot occur.

The present inventor has recognized that altering the knife angle and attack angle permits better optimization of chip quality than altering the knife angle and relief angle as is done in the prior art. The contemplated alteration or modification requires altering the angle between the lower knife-edge-joining portions and the counterknife. Where one of the lower knife-edge-joining portions of a knife having two cutting edges makes contact with the counterknife, such as in the aforementioned Key Knife, Inc. counterknives, altering the knife and attack angles has heretofore required modifying or changing the counterknife as well.

Accordingly, there is a need for a method and apparatus for clamping a knife that provides for decreasing manufacturing costs for the aforedescribed knife, particularly by decreasing the width of the knife, as well as providing for changing the attack angle merely by changing the knife, without impacting the performance of the chipping apparatus employing the knife or destabilizing the contact between the knife and the counterknife.

SUMMARY OF THE INVENTION

A method and apparatus for clamping a knife according to the present invention solves the aforementioned problems and meets the aforementioned needs by providing a knife having front and back sides wherein the front side includes a recess extending along an elongate axis of the knife, the front side terminating in respective cutting edges of the knife, and outer and inner clamping members for clamping the knife therebetween. The width of the recess divided ("normalized") by the distance between the cutting edges yields a result that is preferably no more than about 0.31.

The outer clamping member is adapted to receive the back side of the knife, and the inner clamping member is adapted to receive the front side of the knife, the inner clamping member making contact with the front side of the knife at two spaced locations thereon, wherein at least one of the locations is outside the space between the deflector portions a distance from the closest of the deflector portions, wherein the distance normalized by the aforementioned distance between the cutting edges, yields a result that is preferably no more than about 0.22 from the closest of the deflector portions.

Preferably, the recess is defined by two spaced apart deflector portions and the inner clamping member includes a complementary recess for receiving one of the deflector portions. Preferably as well, the back side of the knife includes a depression and the outer clamping member includes a corresponding projection adapted to fit into the depression and establish a third location of contact for clamping the knife.

Therefore, it is a principal object of the present invention to provide a novel and improved method and apparatus for clamping a knife.

It is another object of the present invention to provide a method and apparatus for clamping a knife that provides for reduced cost of manufacturing the knife.

It is still another object of the present invention to provide a method and apparatus for clamping a knife that provides for decreasing the width of the knife without impacting the performance of the chipping apparatus employing the knife.

It is yet another object of the present invention to provide a method and apparatus for clamping a knife that provides for decreasing the width of the knife without destabilizing the contact between the knife and the counterknife.

It is a further object of the present invention to provide a method and apparatus for clamping a knife having two cutting edges that provides for changing the attack angle of the knife without requiring that the counterknife be changed as well.

It is still a further object of the present invention to provide a method and apparatus for clamping a knife having two cutting edges that provides for changing the attack angle of the knife without requiring that the counterknife be changed as well, and without impacting the performance of the chipping apparatus employing the knife.

It is yet a further object of the present invention to provide a method and apparatus for clamping a knife having two cutting edges that provides for changing the attack angle of the knife without requiring that the counterknife be changed as well, and without destabilizing the contact between the knife and the counterknife.

The foregoing and other objects, features and advantages of the present invention will be more readily understood upon consideration of the following detailed description of the invention, taken in conjunction with the following drawings.

BRIEF DESCRIPTION OF THE DRAWINGS

FIG. 7 is a side elevation of a knife modified for use in the apparatus of FIG. 3, showing an increased attack angle.

FIG. 8 is a side elevation of a knife modified for use in the apparatus of FIG. 3, showing a decreased attack angle.

FIG. 9 is a side section of the knife of FIG. 7 and a counterknife according to the present invention.

FIG. 10 is a side section of the knife of FIG. 8 and the counterknife of FIG. 9.

DETAILED DESCRIPTION OF A PREFERRED EMBODIMENT

Figure 1:
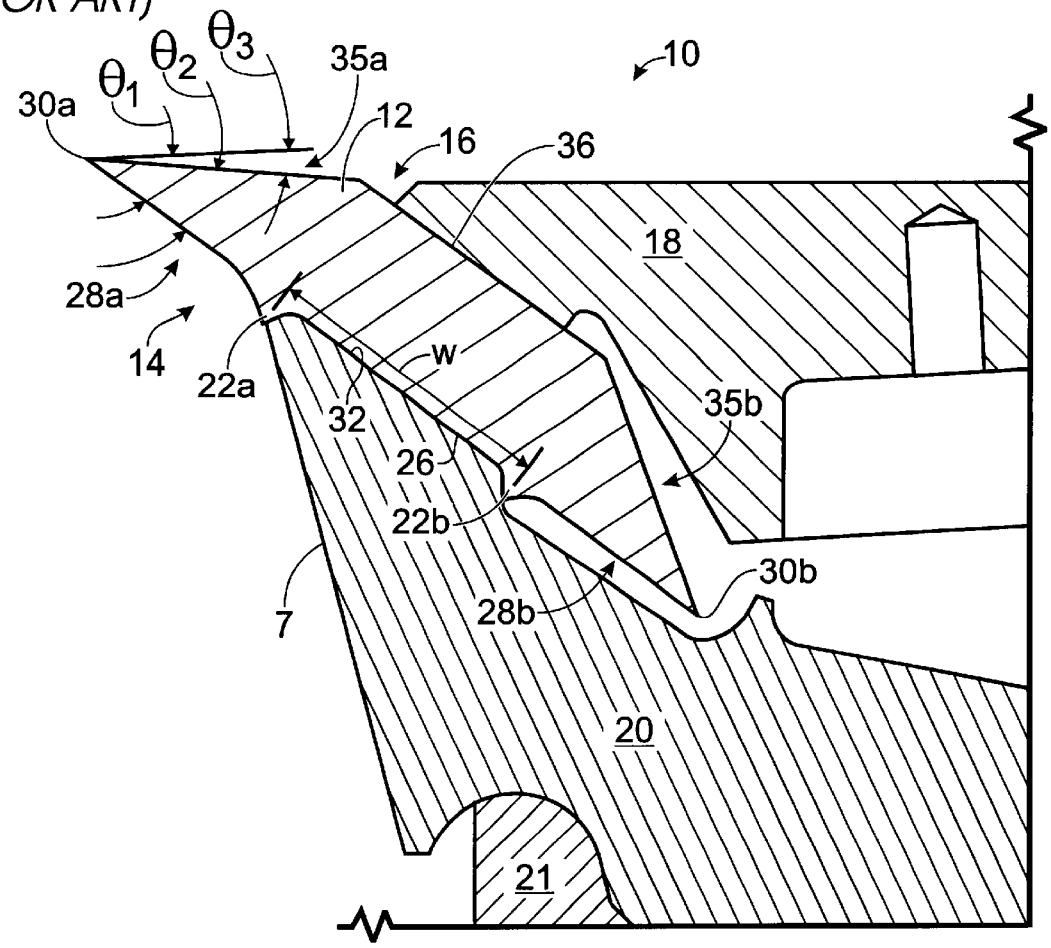
Fig. 1 (PRIOR ART)
FIG. 1 is a side section of a first prior art apparatus for clamping a knife.

Referring to FIG. 1, a prior art apparatus 10 for clamping a knife 12 is shown. The apparatus 10 is a part of a larger wood chipping, shaping or finishing apparatus which is not shown, which typically employs multiple instances of the apparatus 10 on the periphery of a rotating body, which is typically though not necessarily a chipper disc or a drum style cutting head which may have a cylindrical or conical shape. The apparatus 10 essentially forms a cassette for the knife, although the entire cassette is often referred to in the trade as a knife. Herein, the term "knife" is used to refer to the blade that is clamped between the outer and inner clamping members.

Figure 2A:
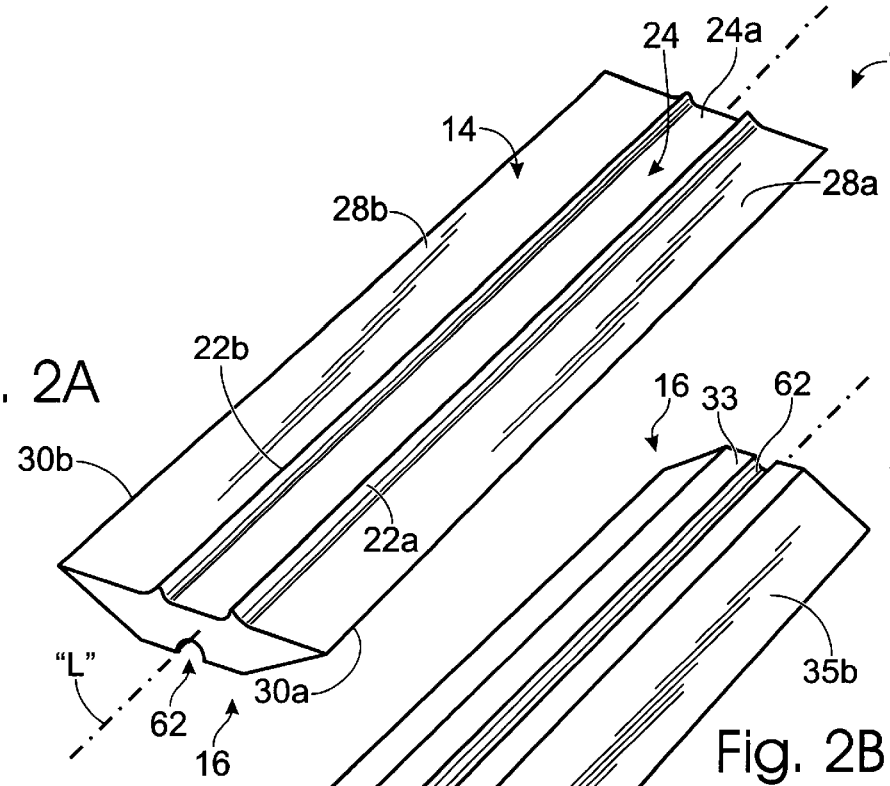
FIG. 2A is a perspective view of a knife according to the present invention, looking up from below.
Figure 2B:
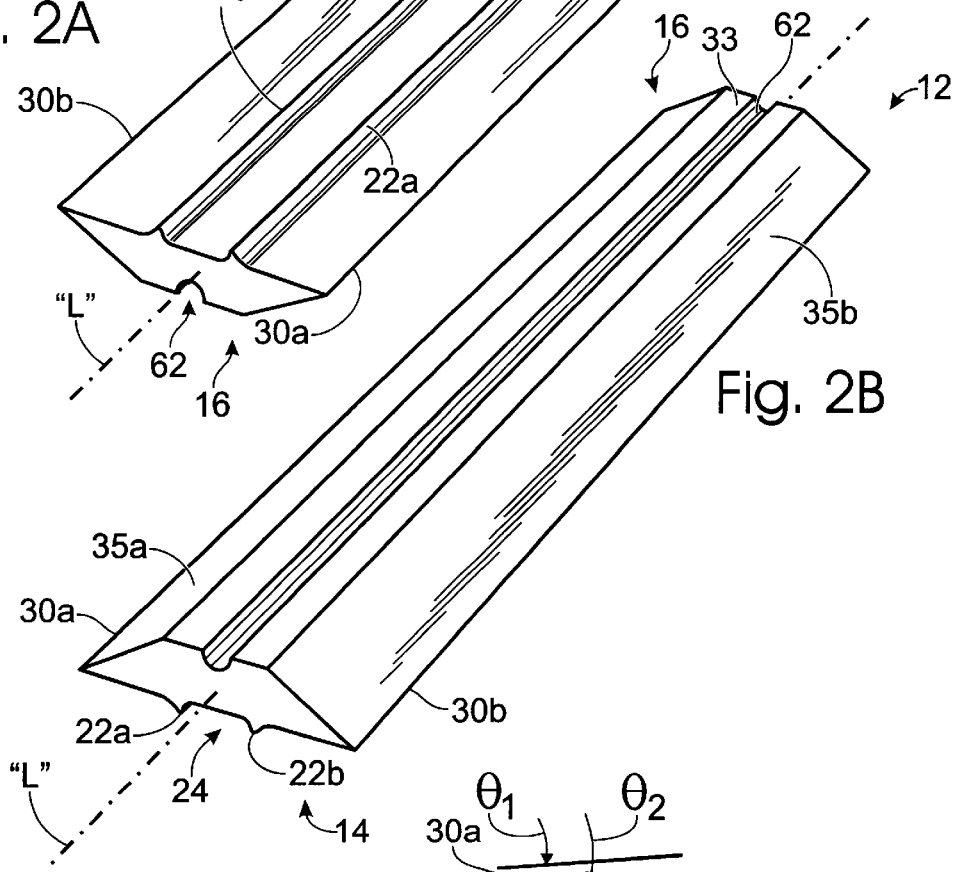
FIG. 2B is a perspective view of the knife of FIG. 1A, looking down from above.

Referring in addition to FIGS. 2A and 2B, the knife 12 is elongate and has an elongate axis "L" that is perpendicular to the plane of FIG. 1. The knife has a front side 14 and back side 16 and is clamped, for operation, between an outer clamping member 18 and a inner clamping member 20, the inner clamping member typically being referred to as a "counterknife." The counterknife provides a wear surface for receiving and channeling chips cut from the wood through the apparatus. The counterknife is shown as rotatable about a base 21 to open the clamping members for changing the knife. Alternative schemes providing for opening the clamping members are well known in the art.

The front side 14 of the knife 12 includes spaced deflector ridges 22*a* and 22*b* that project therefrom. The deflector ridges define a channel 24 and a pressure-applying channel surface portion 24*a* therebetween (FIG. 2A). The channel 24 is effectively a recess in the front side of the knife, which may be provided in other configurations, such as a keyway. The deflector ridges also define two lower knife-edge-joining portions 28*a* and 28*b* that terminate in respective cutting edges 30*a* and 30*b*. The counterknife 20 includes a toe 32 that receives the pressure-applying portion 24*a*. The force applied to the knife is transferred to the counterknife and distributed over the toe 32 through the pressure-applying portion 24*a*.

The back side 16 of the knife 12 includes a clamp-facing surface portion 33 that is substantially planar, and two upper knife-edge-joining portions 35*a* and 35*b* that slope from opposite edges of the clamp-facing surface portion to the cutting edges 30*a* and 30*b*. The knife 12 is typically provided so that the lower knife-edge-joining portion 28*a* lies in the same plane as the lower knife-edge-joining portion 28*b*.

The knife 12 when clamped in the apparatus 10 defines an attack angle $\theta_1$, a knife angle $\theta_2$, and a relief angle $\theta_3$ that is the difference between the attack angle and the knife angle. The knife angle is determined by the knife itself, while the attack and relief angles are determined by the orientation of the knife in the apparatus 10.

It is often desirable to adjust or alter some combination of the aforementioned angles to suit changing cutting conditions. This has typically been accomplished by grinding the upper knife-edge-joining portion or portions of the knife. As can be appreciated with reference to the angles shown in FIG. 1, grinding an upper knife-edge-joining portion alters the knife angle and the relief angles ($\theta_2$ and $\theta_3$), the attack angle remaining the same. For reference in connection with the present invention, it may be noted that grinding a lower knife-edge-joining portion alters the knife angle and the attack angles ($\theta_2$ and $\theta_1$), while the relief angle will remain the same.

Chips are cut from wood at the cutting edge of the knife, the chips traveling past the lower knife-edge-joining portion and an outer surface 7 of the counterknife 20.

Figure 3:
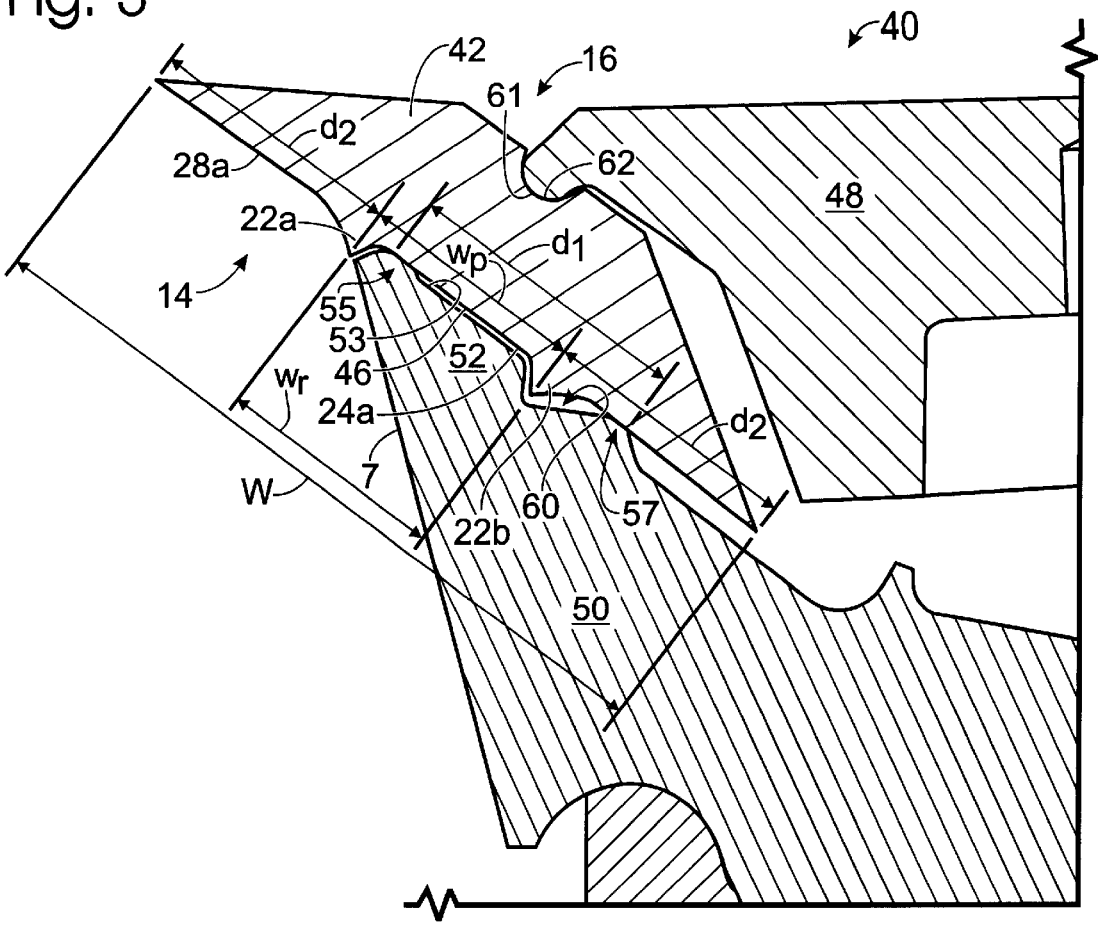
FIG. 3 is a side section of an apparatus for clamping a knife according to the present invention.

Now turning to FIG. 3, an apparatus 40 for clamping a knife 42 according to the present invention is shown. The width "$w_p$" of a pressure-applying portion 46 of the apparatus 40 is less than the corresponding width of the pressure-applying portion 32 of the apparatus 10. Preferably, according to the invention, the width "$w_p$" is substantially equal to a corresponding width "$w_r$" of a recess in the knife defined between the deflector ridges 22*a* and 22*b*. The width $w_r$ is measured tip-to-tip between the deflection ridges 22*a* and 22*b*, and is about 0.54" or less for a knife having a total width "W" of about 1.76 to 1.8." The width "$w_r$" maybe scaled for larger or smaller knives by normalizing it according to the overall width "W", i.e., forming the ratio "$w_r$/W," to provide a result that is no more than about 0.31.

Decreasing the width "$w_r$" decreases the overall width "W" of the knife 42 with respect to the knife 12, providing the outstanding advantage of decreasing manufacturing cost for the knife for the reason mentioned above.

The knife 42 is clamped between an outer clamping member 48 and a counterknife 50. According to the invention, an outer surface of the counterknife 50 includes a toe 52 that, corresponding to the pressure-applying portion 46, has a narrower width than that of the corresponding prior art toe 32 (FIG. 1). The toe 52 includes a first contact surface 55 adjacent the recess, or one of the deflector ridges 22 of the knife, which establishes a first point of contact between the knife and the apparatus 40.

Also according to the invention, a second contact surface 57 is provided on the counterknife 50 that is outside the recess, or space between the deflector ridges of the knife. The distance "$d_1$" between the first contact surface 55 and the second contact surface 57 (outside edge to outside edge) is preferably as great as or may be greater than the width "w" of the prior art toe 32 (FIG. 1), to ensure that decreasing the width of the knife does not destabilize contact between the knife and the counterknife.

In a preferred embodiment of the invention, "$d_1$" is about 0.70" for a knife having an overall width "W" of about 1.76–1.8", or between about 0.65" to 0.75," for a normalized value in the range of about 0.036–0.043. The distance "d2" between the deflector ridges and the respective cutting edges remains the same as in the prior art to ensure that the performance of the chipping apparatus employing the knife is not impacted.

Figure 4:
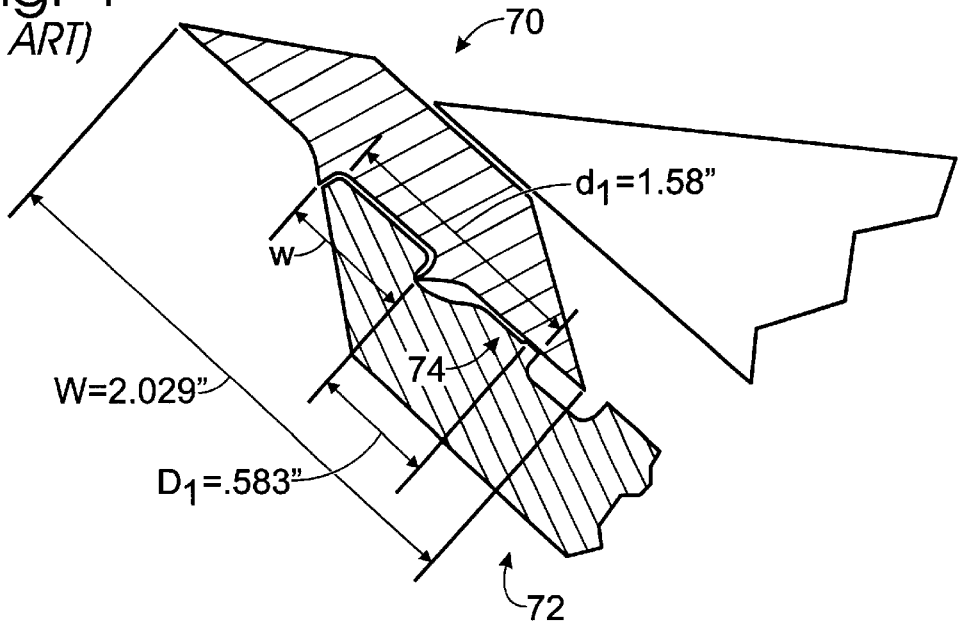
Fig. 4 (PRIOR ART)
FIG. 4 is a side section of a second prior art apparatus for clamping a knife.

Turning to FIG. 4, a prior art counterknife 72 manufactured and marketed by Key Knife, Inc. establishes a contact surface 74 that provides a surface of contact with a corresponding prior art knife 70 having an overall width "W" of 2.03" that extends outside the space defined between the deflector ridges of the knife 70 a distance "D1" of about 0.58" from the nearest deflector ridge. However, as mentioned, the present inventor has recognized that changing the knife and attack angles $\theta_2$ and $\theta_1$, rather than the knife and relief angles as in the prior art, provides the most effective control over the quality of wood chips, and that the magnitude of D1 severely limits or prevents this possibility.

Figure 5:
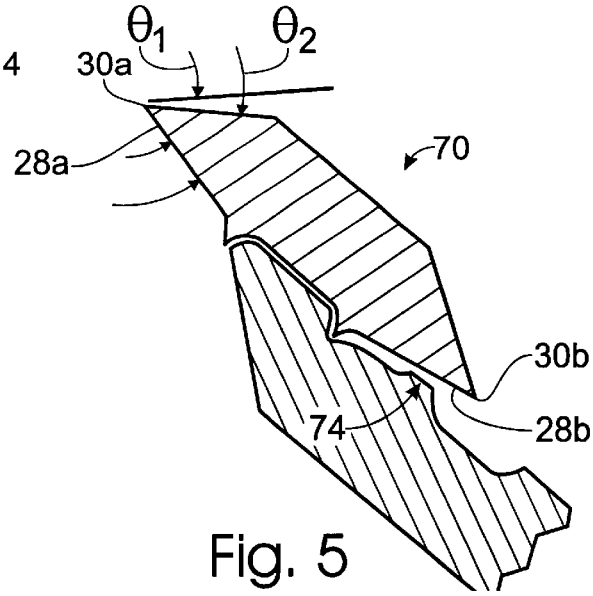
FIG. 5 is a side section of a prior art apparatus for clamping a knife wherein the knife is modified by increasing the knife angle.

FIG. 5 shows the knife 70 wherein the knife angle $\theta_2$ for both cutting edges 30*a* and 30*b* is modified by grinding the lower knife-edge-joining portions 28, resulting in an increased knife angle $\theta_3$ (see FIG. 7) for both cutting edges and an increased attack angle $\theta_1$ for the cutting edge 30*a* when the knife is clamped in the chipping apparatus. As shown, the grinding causes separation of the lower knife-edge-joining portion 28*b* associated with the cutting edge 30*b* from the contact surface 74, destabilizing the contact between the knife and counterknife.

Figure 6:
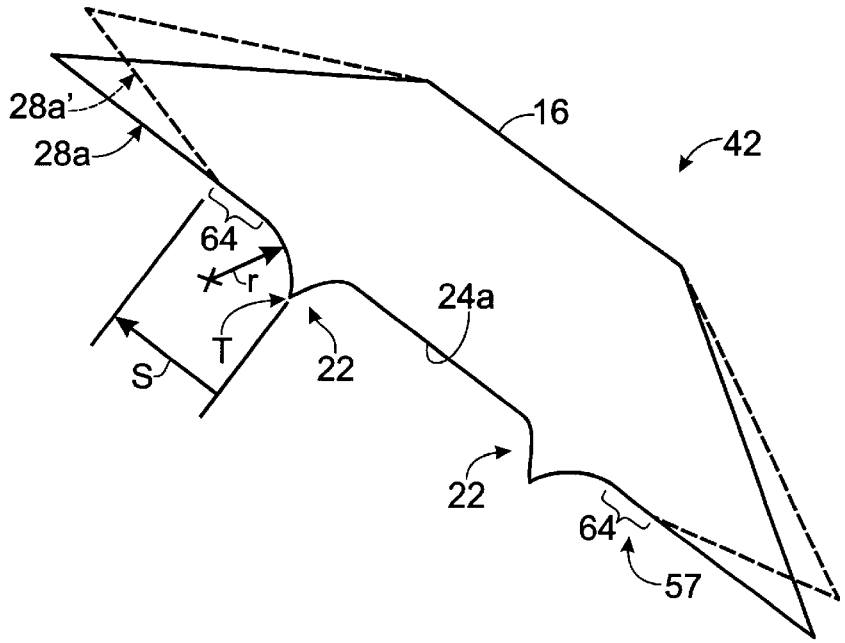
FIG. 6 is a side elevation of a an unmodified knife for use in the apparatus of FIG. 3.

To solve this problem, the contact surface 74 is moved closer to the deflector ridges 22. Turning to FIG. 6, the knife 42 of the present invention includes flat portions (hereinafter "flats") 64 corresponding to each deflector ridge outside the channel between the deflector ridges. The flats are substantially parallel to the pressure-applying channel surface 24*a* (FIG. 2A), and serve as a convenience in manufacturing. However, according to the invention, these flats are used for the additional purpose of providing a region of contact for the contact surface 57 of the counterknife 50 (FIG. 3).

In a preferred embodiment of the invention, the outer end of the flat 64 is located a distance "s" from the recess, or the tip "T" of the deflector ridge, that is equal to the typical radius "r" of 0.25" of the deflector ridge plus a distance 0.10" corresponding to the width of the flat, or about 0.35." For a knife 42 having an overall width "W" (FIG. 3) of about 1.8", this normalizes to a ratio "s/W" of 0.194.

Preferably, the ratio "s/W" is no more than about 0.22, and may be significantly less than 0.194 where the recess is defined more sharply than by use of the radiused deflector ridge. However, persons of ordinary skill in the art will appreciate that the distance "s" may be increased and the present capability to alter the knife and attack angles may be retained by sacrificing the width of the lower-knife-edge joining portions 28. However, it is believed that the prior art ratio of about 0.29 is too large to be satisfactory for the purposes described herein. It may be noted that the ratio s/W also defines the maximum distance that the contact surface 57 may be located from the recess, or the nearest deflector ridge, since the contact surface 57 makes contact with one of the flats.

Each flat extends preferably between 0.08" and 0.12" for the 1.8" wide knife 42, which normalizes to a ratio within the range of about 0.045 to 0.065. Preferably, two flats are symmetrically provided, corresponding to each of the deflector ridges, so that the knife may be turned end-to-end with substantially identical functionality.

Referring back to FIG. 3, the outer surface 53 of the counterknife is preferably relieved, with respect to a plane defined by the contact surfaces 55 and 57, for the entire distance between the contact surfaces to provide for just two points of contact between the knife and counterknife 50, to provide for greater stability of contact and extreme insensitivity to dimensional variations between the parts. Moreover, at a recess 60, the outer surface 53 is relieved to a greater degree to accommodate one of the deflector ridges. The deflector ridges are preferably substantially identical, and the recess 60 is preferably shaped and dimensioned to wholly receive one or the other, so as to leave a clearance therebetween.

The outer clamping member 48 preferably includes an interlocking feature 61 (FIG. 3), such as a projection, adapted to fit into corresponding interlocking feature 62 (FIGS. 2A, 2B) of the back side 16 of the knife, such as a recess or, more particularly in the preferred embodiment, a groove which is preferably semi-cylindrical or, more preferably, substantially half-cylindrical, as disclosed in the aforementioned application entitled KNIFE AND APPARATUS FOR CLAMPING A KNIFE. This establishes a third location of contact for clamping the knife, and also provides the outstanding advantage of holding the knife to the outer clamping member for changing the knife when the outer and inner clamping members are opened with respect to one another, in orientations of the knife wherein the knife rests on the outer clamping member when the knife is unclamped in the chipping apparatus.

Turning to FIG. 7, a side elevation of the knife 42 modified for use in the apparatus of FIG. 3 is shown. The knife is modified by grinding, preferably, both of the lower knife-edge-joining portions 28*a* and 28*b*, so that the knife can be turned end-to-end to permit consecutive use of two cutting edges. The knife-edge-joining portion 28*a* prior to modification is shown in solid lines, and same portion as modified (28*a*') is shown in dotted lines. With reference to a given relief angle $\theta_3$ as defined by the apparatus, it can be seen that the original attack angle $\theta_{1o}$ is increased by the grinding, to $\theta_{1i}$.

Conversely, with reference now to FIG. 8 wherein another side elevation of the knife 42 is shown, the knife may be modified by grinding the lower knife-edge-joining portions to form an undercut 80, to permit decreasing the attack angle $\theta_{1o}$ to $\theta_{1d}$.

Turning to FIG. 9, the knife 42 of FIG. 7 as modified by increasing the knife and attack angles is shown supported by a counterknife 50 according to the present invention. It can be seen that, due to the placement of the contact surface 57 for making contact between the knife and counterknife, the same counterknife used to support the unmodified knife can support the modified knife. Moreover, because the contact surface 57 is outside the space between the deflector ridges, greater contact stability is provided. Similarly, turning to FIG. 10, the knife 42 of FIG. 8 as modified by decreasing the knife and attack angles is shown supported by the same counterknife 50, providing for the same outstanding advantages.

According to the above principles, a series of knives is preferably provided having varying knife angles. A knife having a selected base angle, e.g., 31°, is provided in the series wherein the lower knife-edge-joining portions 28*a* and 28*b* are arranged to be coplanar, and knives wherein this condition is not met may be provided in advance, rather than obtained from the base knife at the point of use by grinding. Other knives in the series may have angles that vary above the base angle (corresponding to FIGS. 7 and 9) and below the base angle (corresponding to FIGS. 8 and 10) in selected, e.g., 2°, increments.

It is to be recognized that, while a specific method and apparatus for clamping a knife has been shown and described as preferred, other configurations could be utilized, in addition to configurations already mentioned, without departing from the principles of the invention.

The terms and expressions which have been employed in the foregoing specification are used therein as terms of description and not of limitation, and there is no intention of the use of such terms and expressions to exclude equivalents of the features shown and described or portions thereof, it being recognized that the scope of the invention is defined and limited only by the claims which follow.

What is claimed is:

1. A knife for use in a wood chipping apparatus, the knife having an elongate axis, and front and back sides co-terminating in two cutting edges defining an overall width "W" of the knife, wherein said front side includes a recess extending along said elongate axis, wherein the width "$w_r$" of said recess, divided by the width "W," results in a value that is less than or equal to about 0.31.

2. The knife of claim 1, wherein said recess is defined by two spaced-apart deflector ridges having respective tips, wherein the width "$w_r$" is measured between said tips.

3. The knife of claim 1, wherein said recess defines a pressure-applying channel surface, wherein the front side of the knife includes a first flat adjacent and outside the recess that is substantially parallel to said channel surface, wherein an outer end of said flat portion is located a distance from said recess that, divided by "W," results in a value that is less than or equal to about 0.22.

4. The knife of claim 2, wherein said recess defines a channel surface between said deflector ridges, wherein the front side of the knife includes a first flat adjacent one of said deflector ridges and outside said recess that is substantially parallel to said channel surface, wherein an outer end of said flat portion is located a distance from the tip of said one of said deflector ridges that, divided by "W," results in a value that is less than or equal to about 0.22.

5. The knife of claim 4, wherein said flat extends a distance that, divided by "W," results in a value within the range of about 0.045 to 0.065.

6. The knife of claim 4, wherein the front side of the knife includes a second flat adjacent the other of said deflector ridges and outside said recess that is substantially parallel to said channel surface, wherein an outer end of said second flat is located a distance from the tip of said one of said deflector ridges that, divided by "W," results in a value that is less than or equal to about 0.22.

7. The knife of claim 1, wherein said back side of said knife includes a groove having a substantially semi-circular cross-section in a plane perpendicular to said elongate axis.

8. The knife of claim 2, wherein said back side of said knife includes a groove having a substantially semi-circular cross-section in a plane perpendicular to said elongate axis.

9. The knife of claim 8, wherein the knife is bilaterally symmetric about a plane parallel to said elongate axis.

10. A counterknife for a knife used in a wood chipping apparatus, the knife having a front side terminating in at least one cutting edge, the counterknife comprising an outer surface for disposition proximate the front side of the knife, said outer surface having two spaced-apart contact surfaces that are raised in elevation relative to the remainder of said outer surface, said contact surfaces being spaced a maximum of about 0.65" to 0.75" apart as measured from corresponding outside edges.

11. The counterknife of claim 10, further including a recess in said front side having a shape and size specially adapted for receiving a deflector ridge of the knife.

12. A wood chipping apparatus comprising:

a knife having front and back sides co-terminating in two cutting edges for the knife, wherein the distance between the cutting edges defines an overall width of the knife, the knife having a recess in said front side; and a counterknife for receiving and making contact with the front side of the knife at just two spaced locations thereon, wherein at least one of said locations is outside said recess a distance "s," wherein the ratio "s/W" is less than or equal to about 0.22.

13. The apparatus of claim 12, wherein the other of said locations makes contact with said knife within said recess.

14. The apparatus of claim 12, further comprising an outer clamping member having an inner surface for disposition proximate said back side of said knife, wherein said back side includes an interlocking feature adapted to interlockingly engage a complementary interlocking feature of said surface of said outer clamping member.

15. The apparatus of claim 14, wherein said interlocking feature of said back side of said knife is a semi-cylindrical groove.

16. The apparatus of claim 15, wherein said groove is substantially half-cylindrical.

17. The apparatus of claim 12, wherein said channel is defined by two spaced-apart deflector ridges projecting from said front side of said knife, and wherein said counterknife includes a recess proximate at least one of said locations that is adapted to receive one of said deflector ridges with a clearance therebetween.

18. The apparatus of claim 17, wherein the other of said locations makes contact with said knife within said recess.

19. The apparatus of claim 17, further comprising an outer clamping member having an inner surface for disposition proximate said back side of said knife, wherein said back side includes an interlocking feature adapted to interlockingly engage a complementary interlocking feature of said surface of said outer clamping member.

20. The apparatus of claim 19, wherein said interlocking feature of said back side of said knife is a semi-cylindrical groove.

* * * * *